US005408722A

United States Patent [19]

Berfield

[11] Patent Number: 5,408,722

[45] Date of Patent: Apr. 25, 1995

[54] HOSE CONNECTOR FOR A VACUUM CLEANER

[75] Inventor: Robert Berfield, Jersey Shore, Pa.

[73] Assignee: Shop Vac Corporation, Williamsport, Pa.

[21] Appl. No.: 132,389

[22] Filed: Oct. 6, 1993

[51] Int. Cl.[6] ..... A47L 9/00

[52] U.S. Cl. ..... 15/327.2; 15/327.6; 285/7; 285/189

[58] Field of Search ..... 15/327.1, 327.2, 327.6, 15/321, 353; 285/7, 189

[56] References Cited

U.S. PATENT DOCUMENTS

| | | | |
|---|---|---|---|
| 2,122,632 | 7/1938 | Baxter | 280/8 |
| 2,284,222 | 5/1942 | Miller | 285/205 X |
| 2,734,594 | 2/1956 | Meeker . | |
| 2,778,447 | 1/1957 | Meyerhoefer . | |
| 2,788,541 | 4/1957 | Kemnitz | 15/330 |
| 2,905,267 | 9/1959 | Thompson . | |
| 2,962,188 | 11/1960 | Eisenhart et al. . | |
| 3,063,082 | 11/1962 | Rosenberg . | |
| 3,087,187 | 4/1963 | Hank et al. | 15/353 X |
| 3,149,362 | 9/1964 | Smithson . | |
| 3,597,902 | 8/1971 | Williams | 55/337 |
| 3,634,905 | 1/1972 | Boyd | 15/350 |
| 3,732,667 | 5/1973 | Fromknecht et al. | 55/373 |
| 3,812,659 | 5/1974 | Westergren et al. | 55/375 |
| 3,910,781 | 10/1975 | Bryant, Jr. | 55/305 |
| 3,988,030 | 10/1976 | Twedell | 285/189 X |
| 4,017,937 | 4/1977 | Hanold . | |
| 4,030,850 | 6/1977 | Hyde | 403/288 |
| 4,114,231 | 9/1978 | Nauta | 15/413 |
| 4,118,208 | 10/1978 | Klinechinst | 55/433 |
| 4,218,805 | 8/1980 | Brazier | 15/321 |
| 4,246,676 | 1/1981 | Hallsworth et al. | 15/353 |
| 4,287,635 | 9/1981 | Jacobs | 15/321 |
| 4,333,202 | 6/1982 | Block | 15/320 |
| 4,334,461 | 6/1982 | Ferguson et al. | 98/119 |
| 4,342,131 | 8/1982 | Reid . | |
| 4,380,845 | 4/1983 | Miller et al. | 15/344 |
| 4,417,639 | 11/1983 | Wegener | 180/125 |
| 4,467,494 | 8/1984 | Jones | 15/353 |
| 4,494,779 | 1/1985 | Neff et al. | 285/159 |
| 4,538,971 | 9/1985 | Miller et al. | 417/423 |
| 4,580,816 | 4/1986 | Campbell et al. | 285/321 |
| 4,606,563 | 8/1986 | Berfield et al. | 285/189 |
| 4,623,366 | 11/1986 | Berfield et al. | 55/216 |
| 4,654,926 | 4/1987 | McCambridge . | |
| 4,693,734 | 9/1987 | Erickson | 15/353 X |
| 4,704,764 | 11/1987 | Metelko, Jr. | 15/301 |
| 4,864,680 | 9/1989 | Blase et al. | 15/353 X |
| 5,012,549 | 5/1991 | Williams et al. | 15/353 X |
| 5,032,155 | 7/1991 | Wiese et al. | 55/216 |
| 5,039,133 | 8/1991 | Albrecht | 285/7 |
| 5,086,537 | 2/1992 | McDowell et al. | 15/353 |
| 5,093,956 | 3/1992 | Saunders et al. | 15/351 |
| 5,257,468 | 11/1993 | Lebrun | 285/189 X |
| 5,287,590 | 2/1994 | Yonkers et al. | 15/353 X |

FOREIGN PATENT DOCUMENTS

| | | | |
|---|---|---|---|
| 3824282 | 1/1990 | Germany | 15/353 |

*Primary Examiner*—Christopher K. Moore
*Attorney, Agent, or Firm*—Marshall, O'Toole, Gerstein, Murray & Borun

[57] ABSTRACT

A hose connector for a vacuum having a lid includes a hose inlet having opening extending through a skirt of the lid, surfaces disposed on one of the hose inlet and the connection end defining slot portions extending in a particular direction and flange portions disposed on opposite sides of the other of the hose inlet and the connection end. Each slot portion has a width sufficient to receive a flange portion. The vacuum is assembled by sliding the connection end into the opening along the particular direction before the lid is assembled on the skirt such that the flange portions are received in the slot portions. The lid is thereafter placed on the tank such that a tank receiving portion of the connection end receives a portion of the tank.

12 Claims, 3 Drawing Sheets

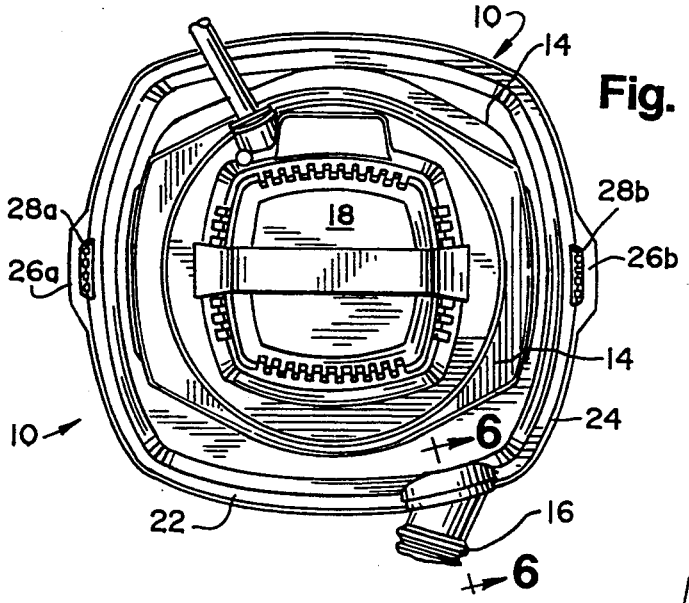
Fig. 3
Fig. 4
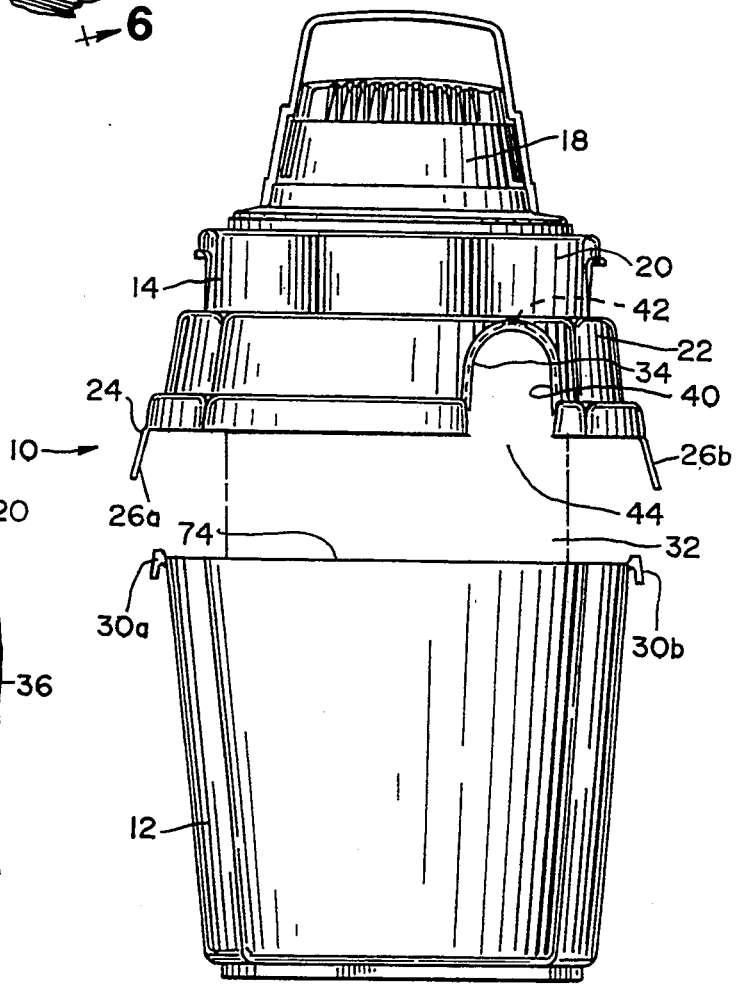
Fig. 5
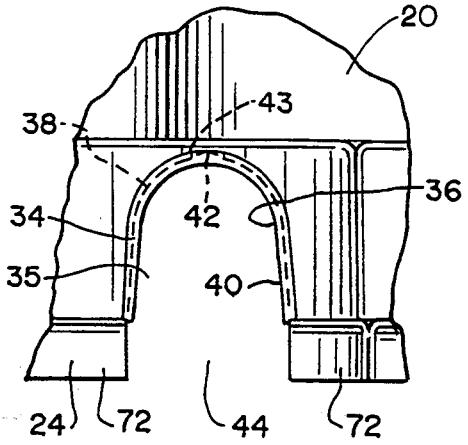

Fig. 6
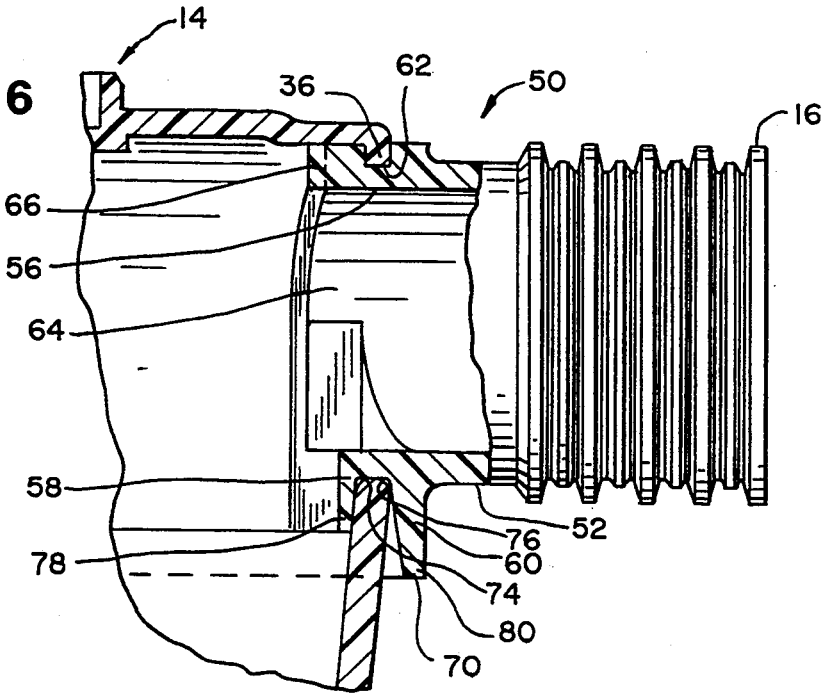
Fig. 7
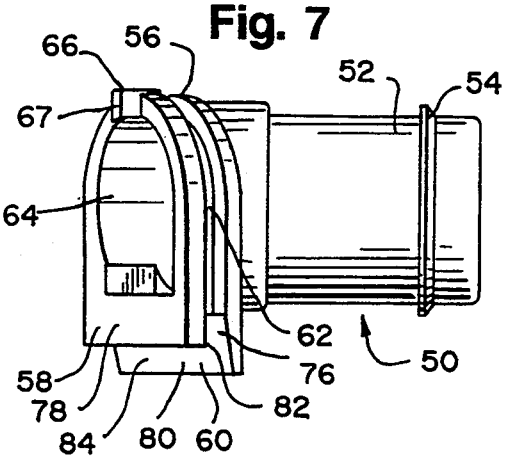
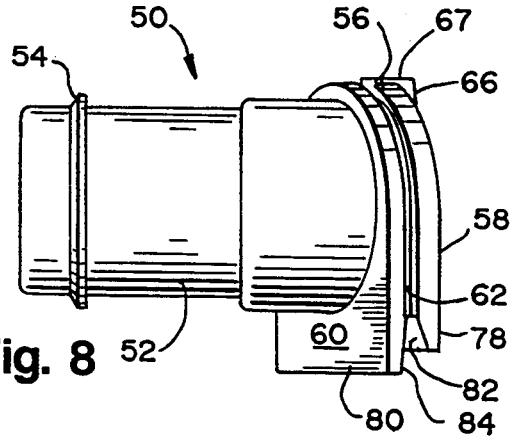
Fig. 8
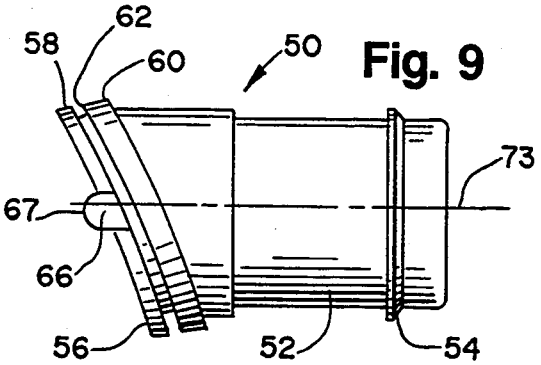
Fig. 9
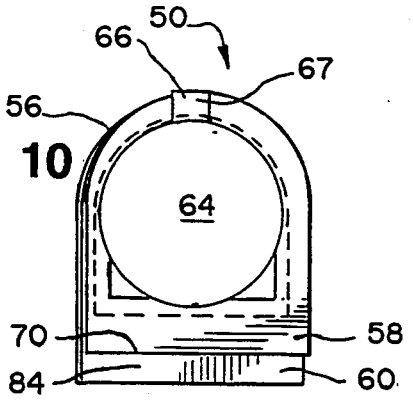
Fig. 10

HOSE CONNECTOR FOR A VACUUM CLEANER

TECHNICAL FIELD

The present invention relates generally to vacuum apparatus, and more particularly to a connector for securing a hose to a vacuum cleaner.

BACKGROUND ART

Vacuum cleaning devices of the tank type, particularly those of the wet/dry variety, generally include a tank, a lid assembly removably disposed on the tank and a hose secured to the lid assembly. Conventionally, the hose is secured to the assembly by means of an interference or friction fit of the hose with walls defining a hose inlet. The tank is typically mounted on casters or wheels to facilitate movement thereof.

Often, during use of the above-described vacuum cleaning device, an operator pulls on the hose as cleaning is undertaken. This pulling can cause the hose to unseat from the hose inlet, thereby resulting in the need for the operator to temporarily interrupt the cleaning process to reseat the hose. In some cases, this interruption can become more frequent with use owing to the presence of dust and debris between the hose and the walls defining the hose inlet or simply due to wear.

SUMMARY OF THE INVENTION

In accordance with the present invention, a hose connector for a vacuum provides a positive and secure connection between the hose and a hose inlet.

More particularly, a hose connector for a vacuum wherein the vacuum includes a lid having a skirt detachably received on a tank and a hose having a connection end includes a hose inlet having an opening extending through the skirt and surfaces disposed on one of the hose inlet and the connection end defining slot portions extending in a particular direction. Flange portions are disposed on opposite sides of the other of the hose inlet and the connection end wherein each slot portion has a width sufficient to receive a flange portion and wherein the connection end further includes a tank receiving portion. The vacuum is assembled by sliding the connection end into the opening along the particular direction before the lid is assembled on the skirt such that the flange portions are received in the slot portions. The lid is thereafter placed on the tank such that the tank receiving portion receives a portion of the tank.

In accordance with a preferred embodiment, the flange portions are disposed on the hose inlet and the slot portions are disposed on the connection end. In a specific embodiment, the flange portions are disposed on opposite sides of the hose inlet and the slot portions are disposed on opposite sides of the connection end.

According to a specific embodiment, the tank receiving portion comprises spaced first and second additional flange portions disposed on opposite sides of an upper wall portion of the tank when the lid is assembled thereon. The skirt preferably has a skirt lower edge wherein the first additional flange portion is disposed outside of the tank and may includes a flange lower edge coincident with the skirt lower edge when the lid is disposed on the tank.

In accordance with a further specific embodiment, the skirt has a skirt lower edge and the opening extends through the skirt lower edge.

According to further specific embodiments, the connection end has a longitudinal axis which extends substantially perpendicular to the particular direction when the hose is assembled to the lid and the opening is offset from a centerline of the lid.

In accordance with a further aspect of the present invention, a hose connector for a vacuum wherein the vacuum includes a lid having a skirt detachably received on a tank and a hose having a connection end wherein the skirt has a skirt lower edge includes a hose inlet having an opening extending through and interrupting the skirt lower edge, the hose inlet further having a first flange surrounding the opening and extending in a particular direction and surfaces defining a slot surrounding the connection end wherein the slot has a width sufficient to receive the flange and wherein the connection end further includes a tank receiving portion having spaced second and third flanges. The vacuum is assembled by sliding the connection end into the opening along the particular direction before the lid is assembled on the tank such that the flange is received in the slot. Thereafter, the lid is placed on the tank such that the second and third flanges are disposed on opposite sides of an upper wall portion of the tank.

The hose connector of the present invention provides a positive and secure attachment of a hose to a hose inlet, thereby minimizing the need to periodically stop and reattach the hose to the hose inlet during use.

BRIEF DESCRIPTION OF THE DRAWINGS

FIG. 3 comprises a plan view of the wet/dry vacuum of FIG. 1;

FIG. 4 comprises a front elevational view of the wet/dry vacuum of FIG. 1 in a disassembled state;

FIG. 5 comprises an enlarged fragmentary view of a portion of the lid assembly of FIG. 4 showing the hose inlet in greater detail;

FIG. 6 comprises a partial sectional view taken generally along the line 6—6 of FIG. 3;

FIG. 7 comprises a side elevational view of the connection end of the hose of FIG. 1;

FIG. 8 comprises a further side elevational view of the connection end of FIG. 7;

FIG. 9 comprises a plan view of the connection end of FIG. 7; and

FIG. 10 comprises a front elevational view of the connection end of FIG. 7.

DESCRIPTION OF THE PREFERRED EMBODIMENTS

Figure 1:
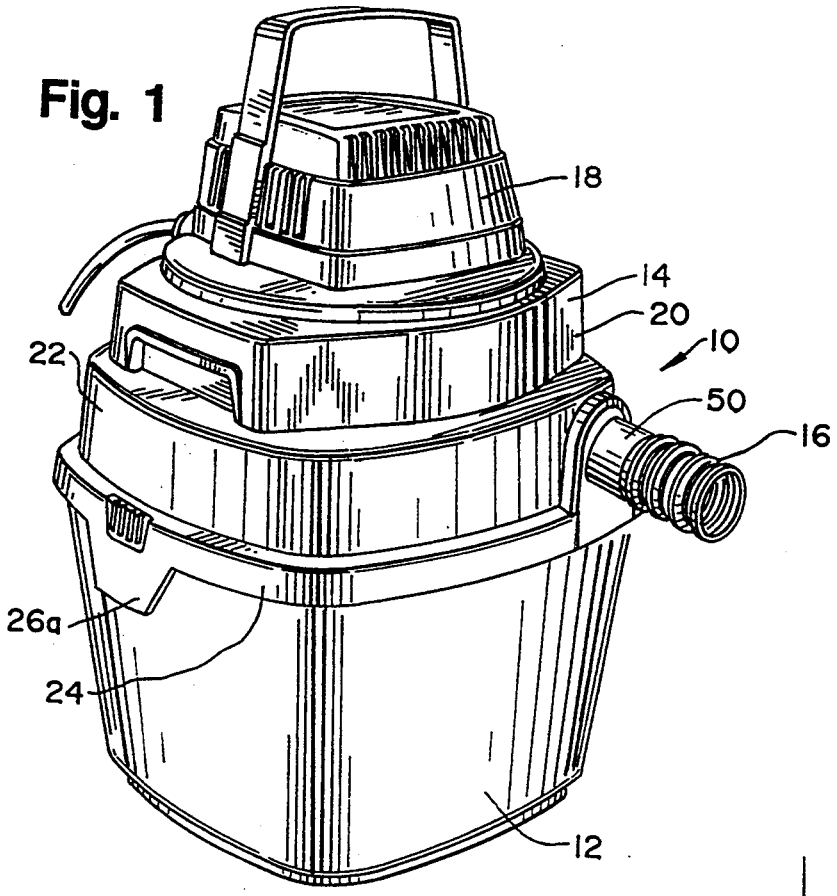
FIG. 1 comprises a perspective view of a wet/dry vacuum incorporating the hose connector of the present invention.
Figure 2:
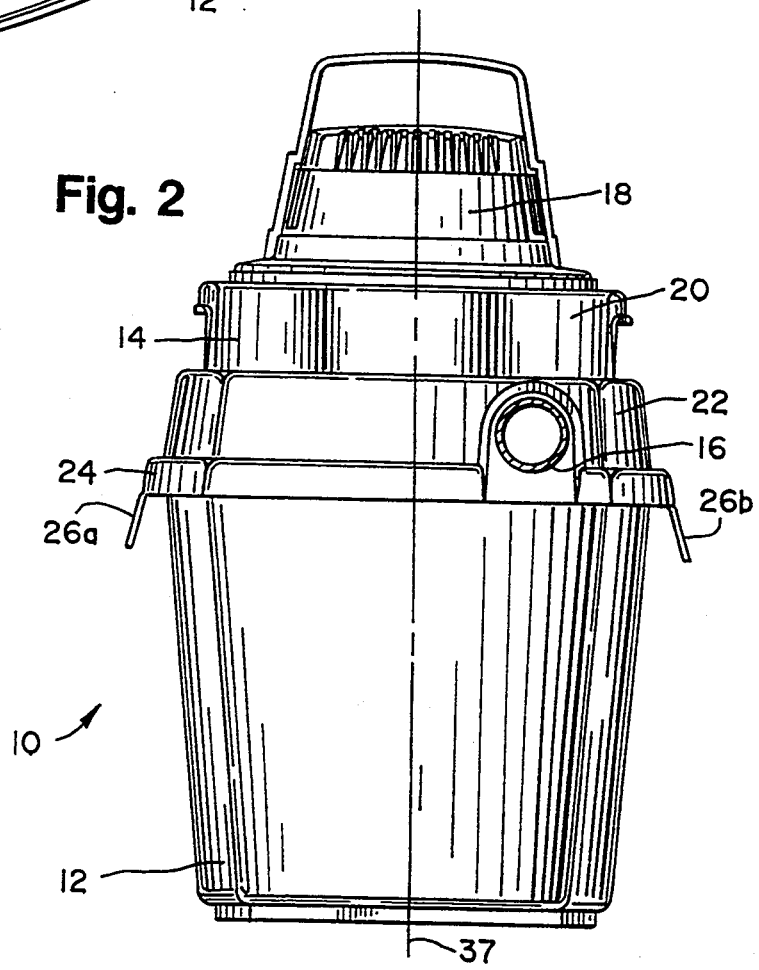
FIG. 2 comprises a front elevational view of the wet/dry vacuum of FIG. 1 with the hose shown in section.

Referring now to FIGS. 1–3, a tank-type wet/dry vacuum 10 includes a tank 12, a lid assembly 14 removably mounted on the tank 12 and a hose 16 (partially shown in FIGS. 1 and 3 and shown in section in FIG. 2). The lid assembly 14 includes a motor cover 18, which encloses a motor (not shown), a blower housing 20 disposed below the motor cover 18 and which encloses a blower (not shown) and a lid cage 22 disposed below the blower housing 20. The lid cage 22 includes a downwardly depending skirt 24 and first and second downwardly extending mounting tabs **26*a*, 26*b*. Openings 28*a*, 28*b*are formed in the skirt 24 in the vicinity of the mounting tabs 26*a*, 26*b*, respectively, which accept and capture outwardly projecting tabs 30***a*, 30*b* when the lid assembly 14 is mounted on the tank 12. The tabs 26*a*, 26*b* are resilient to permit outward deflection thereof to free the tabs 30*a*, 30*b* from the openings 28*a*, 28*b* and thereby permit the lid assembly 14 to be removed from the tank 12, as seen in FIG. 4.

With specific reference to FIG. 4, disposed below the lid cage 22 is a filter 32 which, when the assembly 14 is assembled on the tank 12, is disposed between a hose inlet 34 and an outlet (not shown). As seen in greater detail in FIG. 5, the hose inlet 34 includes an opening 35 bounded at least partially by a flange 36 and offset from a centerline 37 of the vacuum 10 (FIG. 2). The flange 36 has an inner boundary or surface 38 which generally follows the shape of a surface 36 defining the opening 35, except at a central portion 42. The flange 36 extends in a particular direction, in this case generally up and down in the orientation shown in the figures.

In addition to the foregoing, the hose inlet opening 35 extends downwardly and interrupts the skirt 24 at a gap 44, although this need not be the case, as noted in greater detail hereinafter.

FIGS. 6–10 illustrate a connection end 50 for connecting the hose 16 to the lid assembly 14 in greater detail. The connection end 50 includes an elongate hollow barrel 52 having a circumferential flange 54 thereabout and a connection head 56 disposed on an end of the barrel 52. A section of the hose 16 is inserted over the barrel portion and is captured thereon by the flange 54 to secure the connection end 50 thereto.

The connection head 56 includes first and second spaced flanges 58, 60 forming a slot 62 therebetween. A bore 64 extends through the connection head 56 and communicates with the interior of the hollow barrel 52. A boss 66 extends outwardly from an upper central portion of the flange 58 and fits within a complementary surface 43 of the center portion 42, seen in FIG. 5, when the connection end 50 is secured over the hose inlet 34. It should be noted that the boss 66 forms no part of the present invention, it being noted that such element is present simply to allow ejection of the connection head 50 from a mold forming such part.

The connection end 50 is assembled to the lid assembly 14 before the assembly 14 is mounted on the tank 12. The connection end 50 is placed immediately below the hose inlet 34 in the vicinity of the gap 44 in the skirt 24 such that lower portions of the flange 36 are disposed within the upper portions of the slot 62. The slot 62 is preferably sized to snugly accommodate the flange 36. The connection end 50 is then moved upwardly, i.e., along the direction of the flange 36 until the flange 36 is fully seated within the slot 62 and such that the boss 66 extends into the central portion 42, as seen in FIG. 6 and as previously noted. Once the connection end 50 is so placed, a lower edge 70 of the flange 58 is preferably substantially coincident with a lower edge 72 of the skirt 24, as seen in FIGS. 1 and 2. Also, a longitudinal axis 73 (FIG. 9) of the connection end 50 is disposed substantially perpendicular to the extent of the flange 36.

The lid assembly 14, the connection end 50, and the hose 16 may then be placed on the tank 12 such that an upper rim 74 of the tank 12 extends into a recess 76 located between lower portions 78, 80 of the flanges 58, 60, respectively. Inner surfaces 82, 84 (FIGS. 7, 8 and 10) of the lower portion 78, 80, respectively, may be tapered to facilitate insertion of the upper rim 74 into the recess 76, if desired.

As should be evident from the foregoing, the hose connector of the present invention provides a positive and secure attachment of the hose to the hose inlet. The inter-engagement of the flange 36 and the slot 62 together with the engagement of the flanges 58, 60 with the upper lip 74 of the tank, provide a seal which minimizes the loss of vacuum inside the tank 12 during operation.

It should be noted that, instead of the slot 62 being formed on the connection end 5D and the flange 36 being formed on the hose inlet 34, the connection end may include a pair of opposed flange portions on the connection end 50 and at least a pair of opposed slot portions formed on the hose inlet 34.

Further, the opening 34 need not extend fully and completely interrupt the skirt 24; rather, an enlarged opening may be formed to one side of the opening 35 large enough to admit at least the flange 58 therein so that the flange 58 can be guided behind the flange 36.

While one or more embodiments of the invention have been illustrated and described in detail, it should be understood that modifications and variations of these embodiments may be effected without departing from the spirit of the invention and the scope of the following claims.

I claim:

1. A hose connector for a vacuum cleaner wherein the vacuum cleaner includes a lid having a skirt detachably received on a tank and a hose having a connection end, comprising:

a hose inlet having an opening extending through the skirt, wherein the opening has an opening lower edge;

surfaces disposed on one of the hose inlet and the connection end defining slots; and flanges disposed on the hose inlet and the connection end wherein each slot has a width sufficient to receive a flange, the connection end further including a tank receiving portion;

wherein the vacuum cleaner is assembled by sliding the connection end through the opening lower edge into the opening before the lid is assembled on the skirt such that the flanges are received in the slots and wherein the lid is thereafter placed on the tank such that the tank receiving portion receives a portion of the tank.

2. The hose connector of claim 1, wherein the flanges are disposed on the hose inlet and the slots are disposed on the connection end.

3. The hose connector of claim 1, wherein the flanges are disposed on opposite sides of the hose inlet and the slots are disposed on opposite sides of the connection end.

4. The hose connector of claim 1, wherein the tank receiving portion comprises spaced first and second additional flanges disposed on opposite sides of an upper wall portion of the tank when the lid is assembled thereon.

5. The hose connector of claim 4, wherein the skirt has a skirt lower edge and wherein the first additional flange is disposed outside of the tank and includes a flange lower edge coincident with the skirt lower edge when the lid is disposed on the tank.

6. The hose connector of claim 1, wherein the skirt has a skirt lower edge and wherein the opening extends through the skirt lower edge.

7. The hose connector of claim 1, wherein the connection end has a longitudinal axis which extends substantially perpendicular to the slots and flanges when the hose is assembled to the lid.

8. The hose connector of claim 1, wherein the opening is offset from a centerline of the lid.

9. A hose connector for a vacuum cleaner wherein the vacuum cleaner includes a lid having a skirt detachably received on a tank and a hose having a connection end wherein the skirt has a skirt lower edge, comprising:

a hose inlet having a opening extending through and interrupting the skirt lower edge, the hose inlet further having a first flange surrounding the opening; and surfaces defining a slot surrounding the connection end wherein the slot has a width sufficient to receive the flange, the connection end further including a tank receiving portion including spaced second and third flanges;

wherein the vacuum cleaner is assembled by sliding the connection end into the opening before the lid is assembled on the tank such that the flange is received in the slot and wherein the lid is thereafter placed on the tank such that the second and third flanges are disposed on opposite sides of an upper wall portion of the tank.

10. The hose connector of claim 9, wherein the second flange is disposed outside of the tank and includes a flange lower edge coincident with the skirt lower edge when the lid is disposed on the tank.

11. The hose connector of claim 9, wherein the connection end has a longitudinal axis which extends substantially perpendicular to the slot and flange when the hose is assembled to the lid.

12. The hose connector of claim 9, wherein the opening is offset from a centerline of the lid.

* * * * *